US009449588B2

(12) United States Patent
Verderosa

(10) Patent No.: US 9,449,588 B2
(45) Date of Patent: Sep. 20, 2016

(54) SINGLE CONTAINER-BASED PORTABLE DRUM KIT

(71) Applicant: Mathew Verderosa, Pocono Lake, PA (US)

(72) Inventor: Mathew Verderosa, Pocono Lake, PA (US)

( * ) Notice: Subject to any disclaimer, the term of this patent is extended or adjusted under 35 U.S.C. 154(b) by 0 days.

(21) Appl. No.: 14/705,054

(22) Filed: May 6, 2015

(65) Prior Publication Data

US 2015/0325222 A1 Nov. 12, 2015

Related U.S. Application Data

(60) Provisional application No. 61/990,253, filed on May 8, 2014.

(51) Int. Cl.

| | |
|---|---|
| ***G10K 11/00*** | (2006.01) |
| ***G10G 7/00*** | (2006.01) |
| ***G10G 5/00*** | (2006.01) |
| ***G10D 13/02*** | (2006.01) |
| ***G10D 13/00*** | (2006.01) |

(52) U.S. Cl.
CPC ..... *G10G 7/005* (2013.01); *G10D 13/00* (2013.01); *G10D 13/02* (2013.01); *G10G 5/00* (2013.01)

(58) Field of Classification Search
CPC ..... G10K 11/025
USPC ..... 181/189, 190, 198, 148; 84/412, 411 R
See application file for complete search history.

(56) References Cited

U.S. PATENT DOCUMENTS

| | | | | |
|---|---|---|---|---|
| 2,231,235 | A * | 2/1941 | Weir | 206/314 |
| 5,821,471 | A * | 10/1998 | McCuller | 181/156 |
| 6,035,962 | A * | 3/2000 | Lin | 181/199 |
| 6,043,556 | A | 3/2000 | Tomie | |
| 6,284,959 | B1 | 9/2001 | Nicolosi | |
| 7,365,258 | B1 * | 4/2008 | Lombardi | 84/422.1 |
| 7,420,110 | B2 | 9/2008 | May | |
| 7,556,122 | B2 * | 7/2009 | Moore | 181/156 |
| 8,066,095 | B1 * | 11/2011 | Bromer | 181/152 |
| 8,263,847 | B2 | 9/2012 | Saravis | |
| 8,263,848 | B2 * | 9/2012 | Aspland | 84/415 |
| 2005/0252358 | A1 * | 11/2005 | Izen et al. | 84/411 R |
| 2008/0034944 | A1 * | 2/2008 | Aspland | 84/415 |

FOREIGN PATENT DOCUMENTS

| | | | | |
|---|---|---|---|---|
| JP | 2002287745 | * | 10/2002 | H01R 1/02 |

* cited by examiner

*Primary Examiner* — Forrest M Phillips
(74) *Attorney, Agent, or Firm* — Wendy W. Koba

(57) ABSTRACT

A drum kit container is configured to house various compartments sufficient to stow all of the equipment needed by a drummer in setting up a drum kit. One compartment is sized to house a relatively small bass drum, with an acoustic chamber formed behind this compartment and used to improve the sound of a small bass drum so that it sounds more like a larger bass drum as generally used in performance.

10 Claims, 11 Drawing Sheets

SINGLE CONTAINER-BASED PORTABLE DRUM KIT

CROSS-REFERENCE TO RELATED APPLICATIONS

This application claims the benefit of U.S. Provisional Application Ser. No. 61/990,253, filed May 8, 2014 and herein incorporated by reference.

BACKGROUND OF THE INVENTION

A standard four-piece drum kit consists of a snare drum, a bass drum, a floor-mounted tom-tom drum (also referred to as a "floor tom") and a tom-tom drum that is somewhat elevated and attached to a hanging device or rack (also referred to as a "rack tom"). Besides the drums, the kit generally includes cymbals, a floor pedal, and hardware for attaching the drums in their preferred configuration (as well, in some cases, a seat for the drummer). For every performance, this equipment needs to be packed, transported and then unloaded. When the performance is over, the equipment must once again be packed, transported home and unloaded. Not only is this tedious, but transportation space (such as in a car) is usually very limited. In most cases, the drums are packed in separate suitcases or trunks, making the entire collection of baggage a significant load.

SUMMARY OF THE INVENTION

The present invention addresses this problem, providing a storage container that is particularly configured to house a relatively small bass drum. The container is also used to transport other percussion instruments, such as a snare drum, a floor tom and a rack tom. These other drums are then removed from the container during a performance (while the bass drum remains in the container). The container itself may be formed of a size of approximately 32" tall by 20" wide and 20" deep.

In accordance with the present invention, the use of a relatively small bass drum (e.g., a 16" bass drum as opposed to a 20-24" bass drum) is compensated for by incorporating an acoustic configuration within the container (i.e., an acoustic chamber, channel and aperture) and positioned behind the bass drum. Additional baffling elements may be formed within the acoustic chamber in the container that propagate the sound created by the small bass drum through the container in a manner that creates the desired, deep resonant tone.

A particular embodiment of the present invention comprises a drum kit container of generally rectangular form, the container including an acoustic configuration and comprising a main compartment including an upper section and a lower section, the lower section including a first area and a second area configured in a front and back configuration such that the first and second areas are both disposed below the upper section, the first area for housing a bass drum with a drumhead facing outward, and the second area including at least a portion of the acoustic configuration and comprising an acoustic chamber, the main compartment further comprising an acoustic channel in acoustic communication with the acoustic chamber and extending upward along a side surface of the main compartment, terminating in an aperture, the combination of the acoustic chamber, acoustic channel and aperture forming the acoustic configuration.

Another embodiment includes, in addition to this main compartment, a secondary compartment having the same surface area dimensions as the main compartment such that the secondary compartment is capable being disposed over and attached to the main compartment, the combination of the main and secondary compartments forming a container for housing a bass drum and other drum equipment in a portable, compact arrangement.

Other and further arrangements, advantages and embodiments of the present invention will become apparent during the course of the following discussion and by reference to the accompanying drawings.

BRIEF DESCRIPTION OF THE DRAWINGS

Referring now to the drawings, where like numerals represent like parts in several views.

DESCRIPTION OF THE INVENTION

Figure 1:
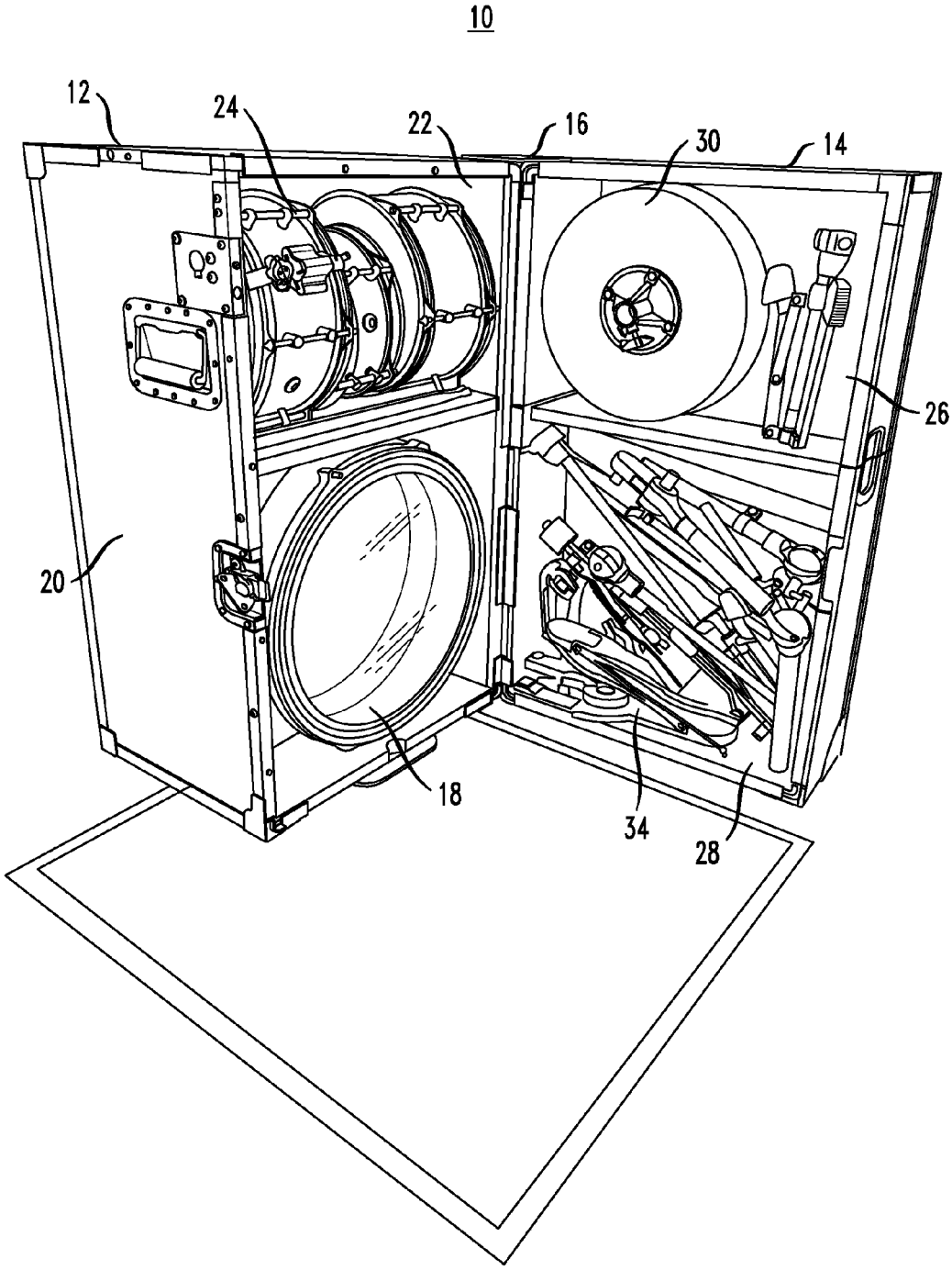
FIG. 1 is an isometric view of an exemplary drum kit container formed in accordance with the present invention, the illustration of FIG. 1 showing the container in its open position, with a bass drum disposed within its defined location and other components of drum equipment stowed within other compartments of the container.
Figure 2:
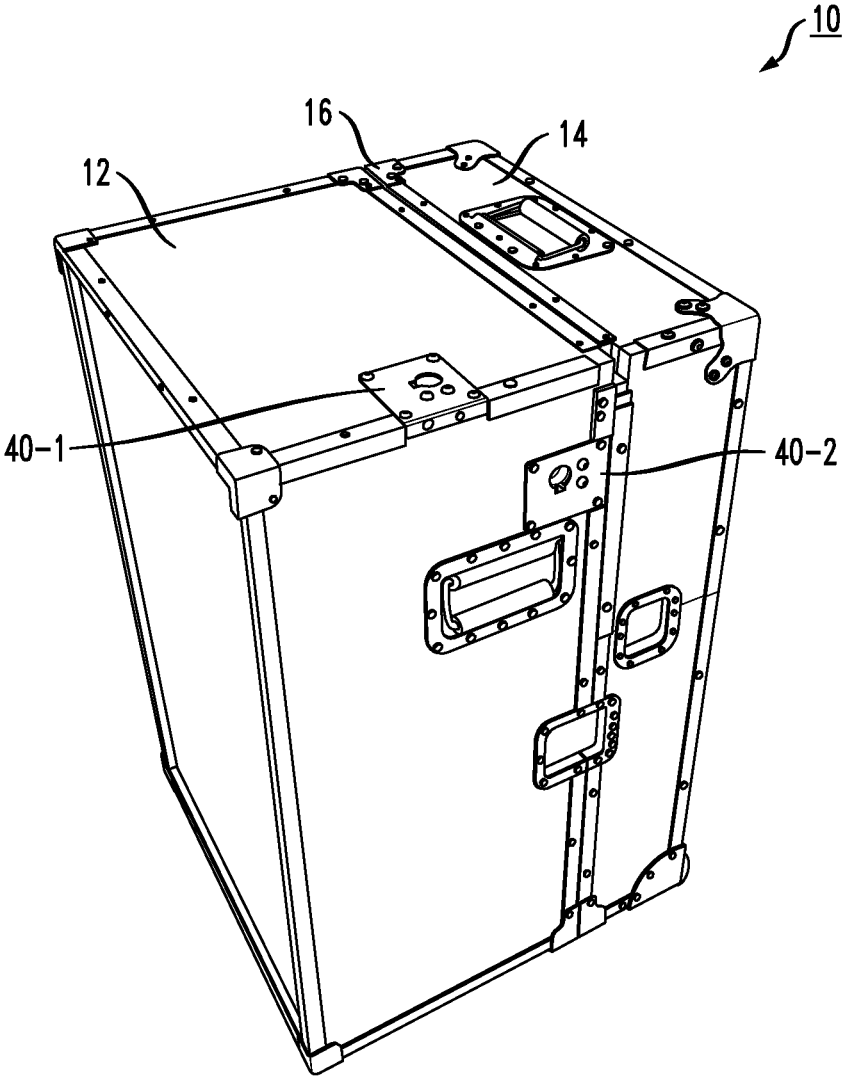
FIG. 2 illustrates drum kit container in its "closed" position, with all equipment stowed therein so as to be easily transported from one location to another.

FIG. 1 is an isometric view of an exemplary drum kit container 10, formed in accordance with the present invention. In this view, container 10 is shown in its "open" position, showing in detail a relatively deep main compartment area 12 and a relatively shallow secondary compartment area 14. In this particular embodiment the two compartments are connected together via a hinge member 16. Drum kit container 10 can be thought of as being similar to a "trunk", with main compartment area 12 similar to the storage area and secondary compartment area 14 similar to the lid. Indeed, FIG. 2 illustrates drum kit contain 10 in its "closed" position, and its similarity to a trunk is noticeable.

Returning to the description of the present invention as shown in FIG. 1, main compartment area 12 of container 10 is shown as used to store a relatively small bass drum 18 in a lower section 20. As mentioned above, the inventive acoustic configuration of container 10 allows for a relatively small drum (i.e. a 16" drum as opposed to a more conventional 20"-24" drum) to be used. The particulars of the acoustic configuration will be discussed hereinbelow in association with FIGS. 9-11.

Main compartment area 12 of container 10 also includes an upper section 22, used for storing the remaining drums 24 (e.g., floor torn, rack tom, snare, etc.). As will be shown below, these drums 24 are removed from container 10 when the kit is being set up for a performance. Bass drum 18, in contrast, remains stored within lower section 20 during performance.

Secondary compartment area 14 of drum kit container 10 (the shallower of the two compartment areas) includes, in this embodiment as shown in FIG. 1, an upper section 26 and a lower section 28. In this particular example, seat components 30 are stored in upper section 26 and drum stand elements 32 (hereinafter referred to as "hardware") and floor pedals 34 are stored in lower section 28.

Figure 3:
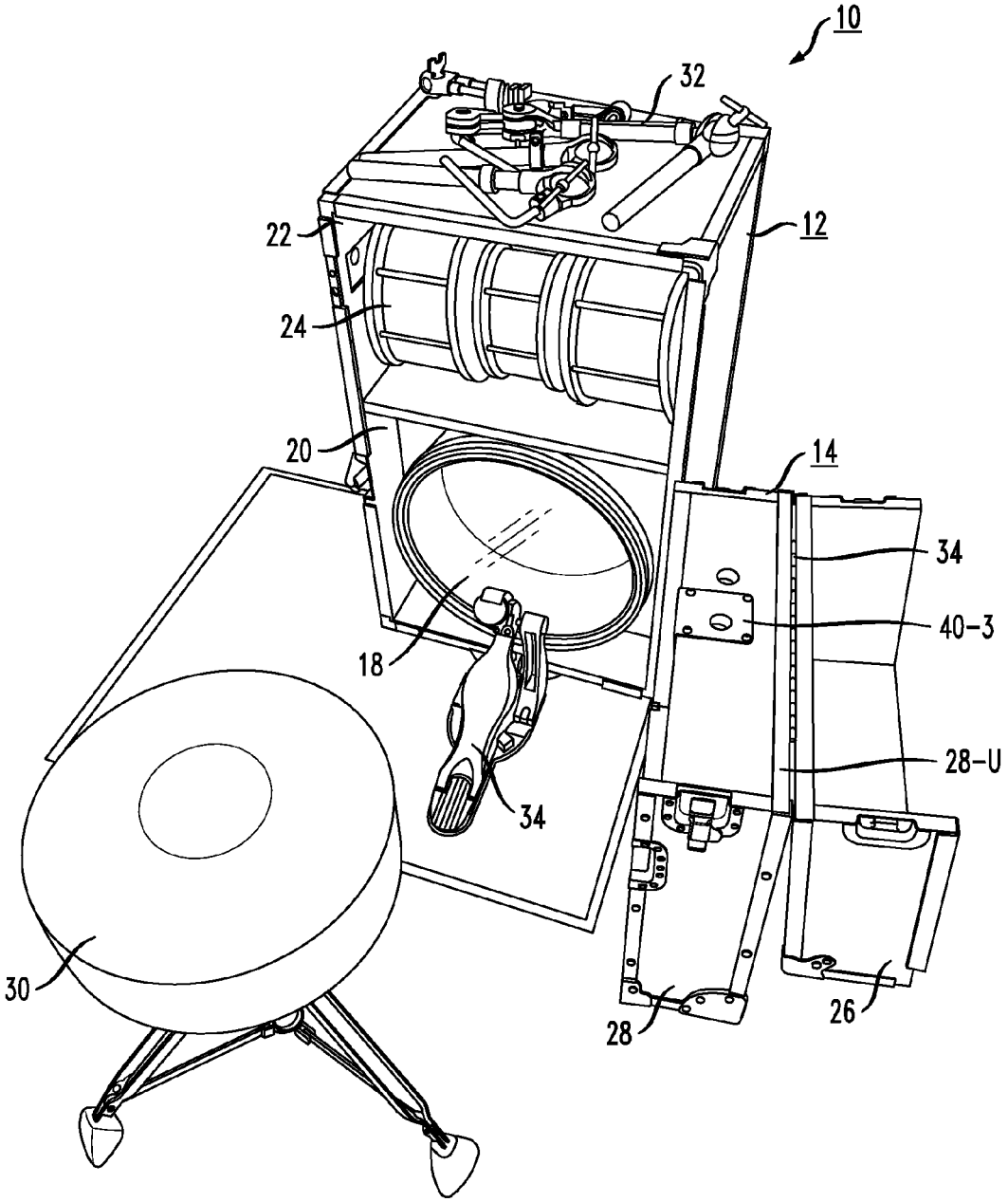
FIG. 3 is another isometric view of the inventive drum kit container in its open position, in this case with a portion of the equipment removed from the container (in particular, from the secondary ("lid") portion of the container)

FIG. 3 illustrates drum kit container 10 in an intermediate form as the kit is being set up for a performance. In this view, seat components 30 have been removed and assembled, as shown. Hardware 32 and floor pedals 34 have been removed from upper section 26 of secondary compartment area 14. In this particular embodiment, secondary compartment area 14 is itself formed as a hinged component, including a hinge member 34 disposed across the interface between upper section 26 and lower section 28. A floor pedal 34 is shown in FIG. 3 as being positioned for use with bass drum 18.

Figure 4:
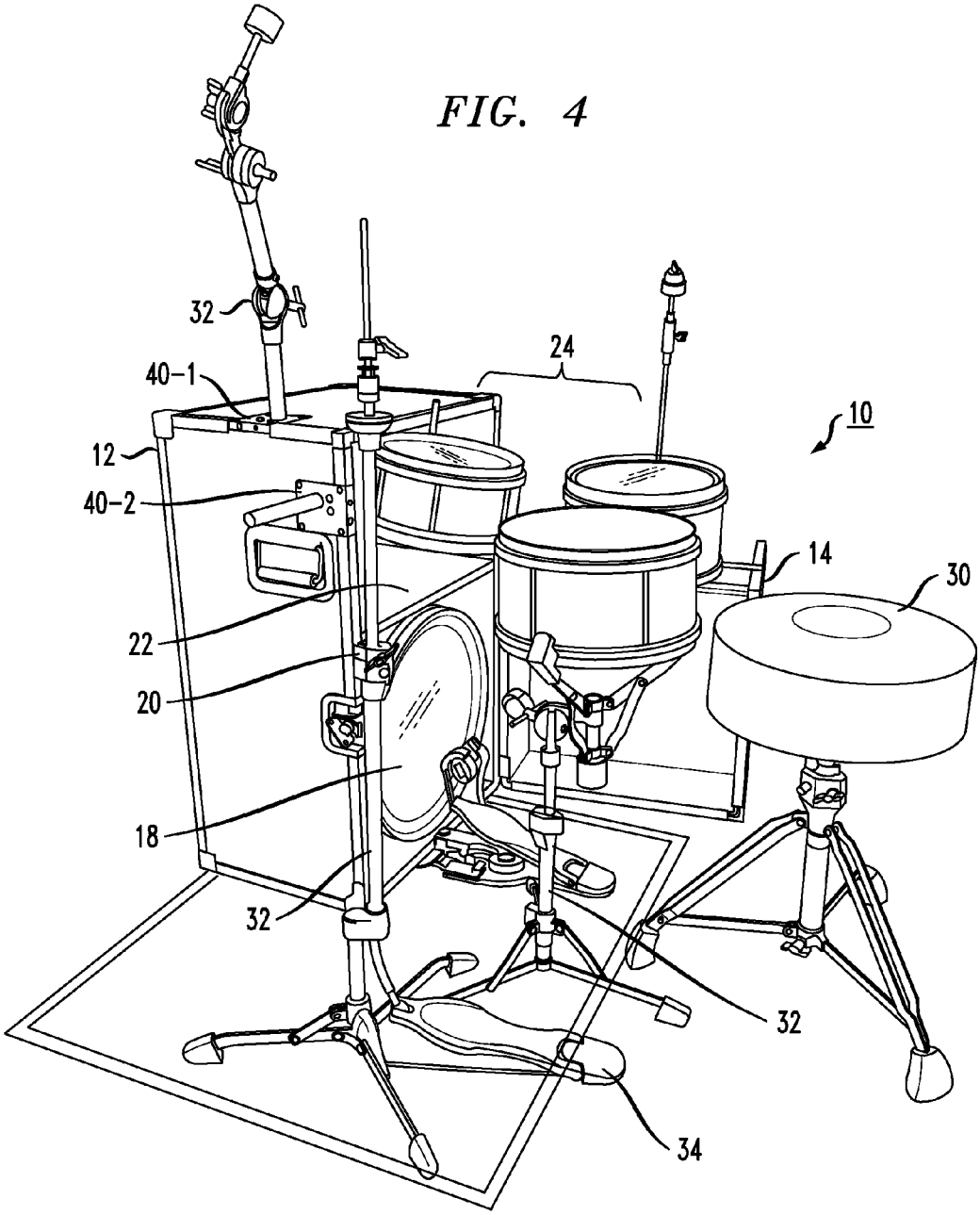
FIG. 4 shows the inventive drum kit with all necessary components removed, and a bass drum remaining in its performance position within the container.
Figure 5:
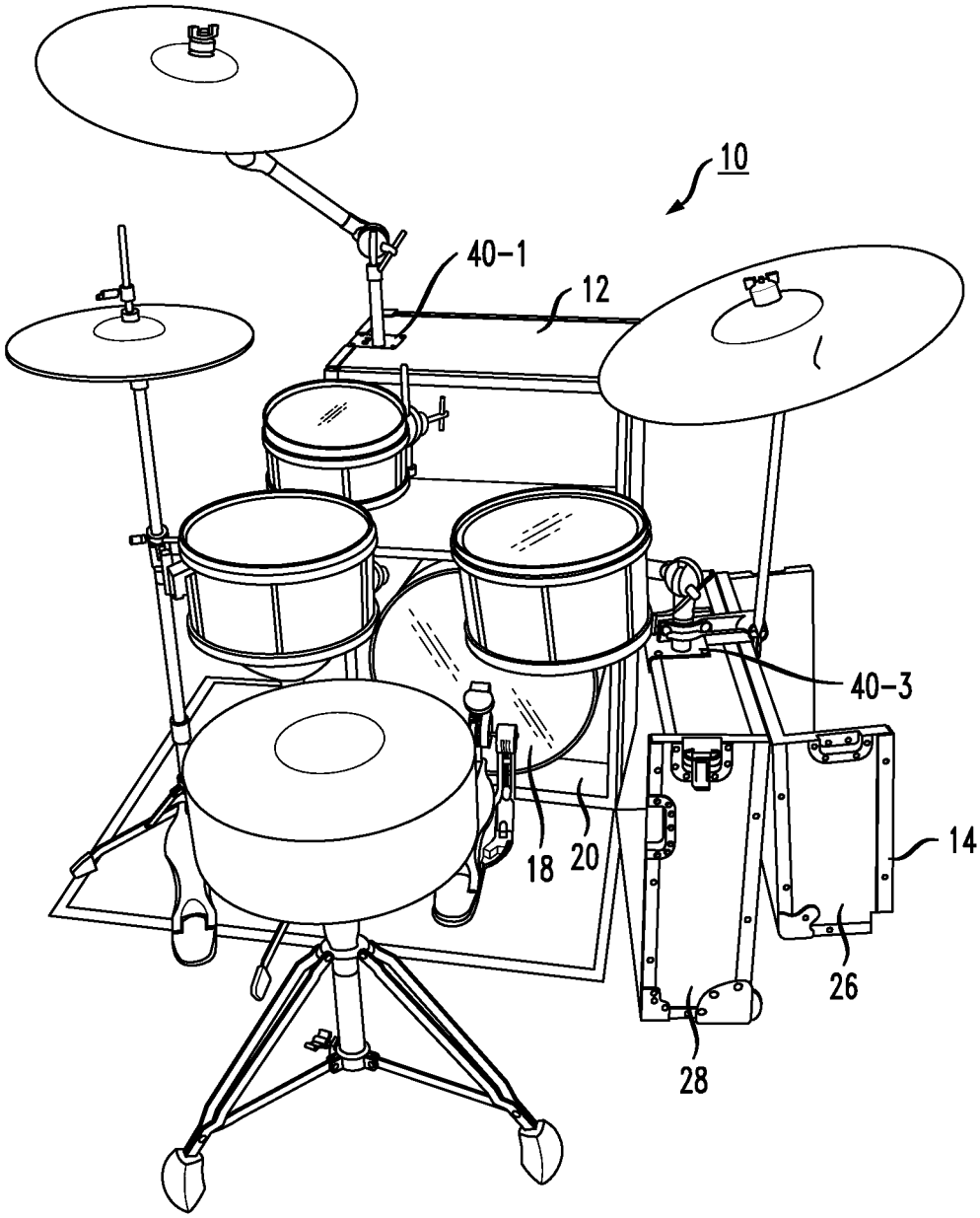
FIGS. 5-8 are alternative view of a complete drum kit set up, using components stored within the drum kit container of the present invention.
Figure 6:
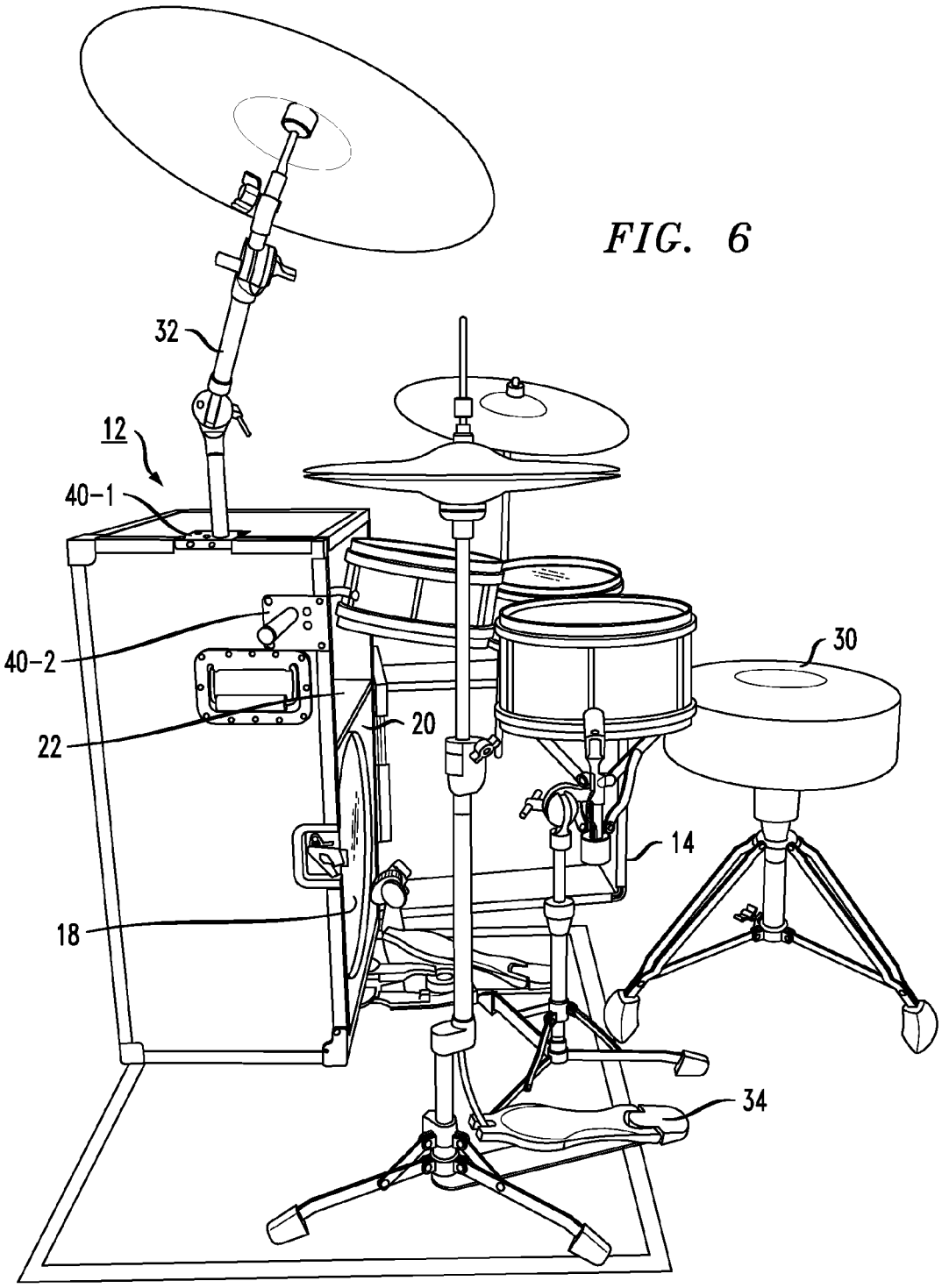
Figure 7:
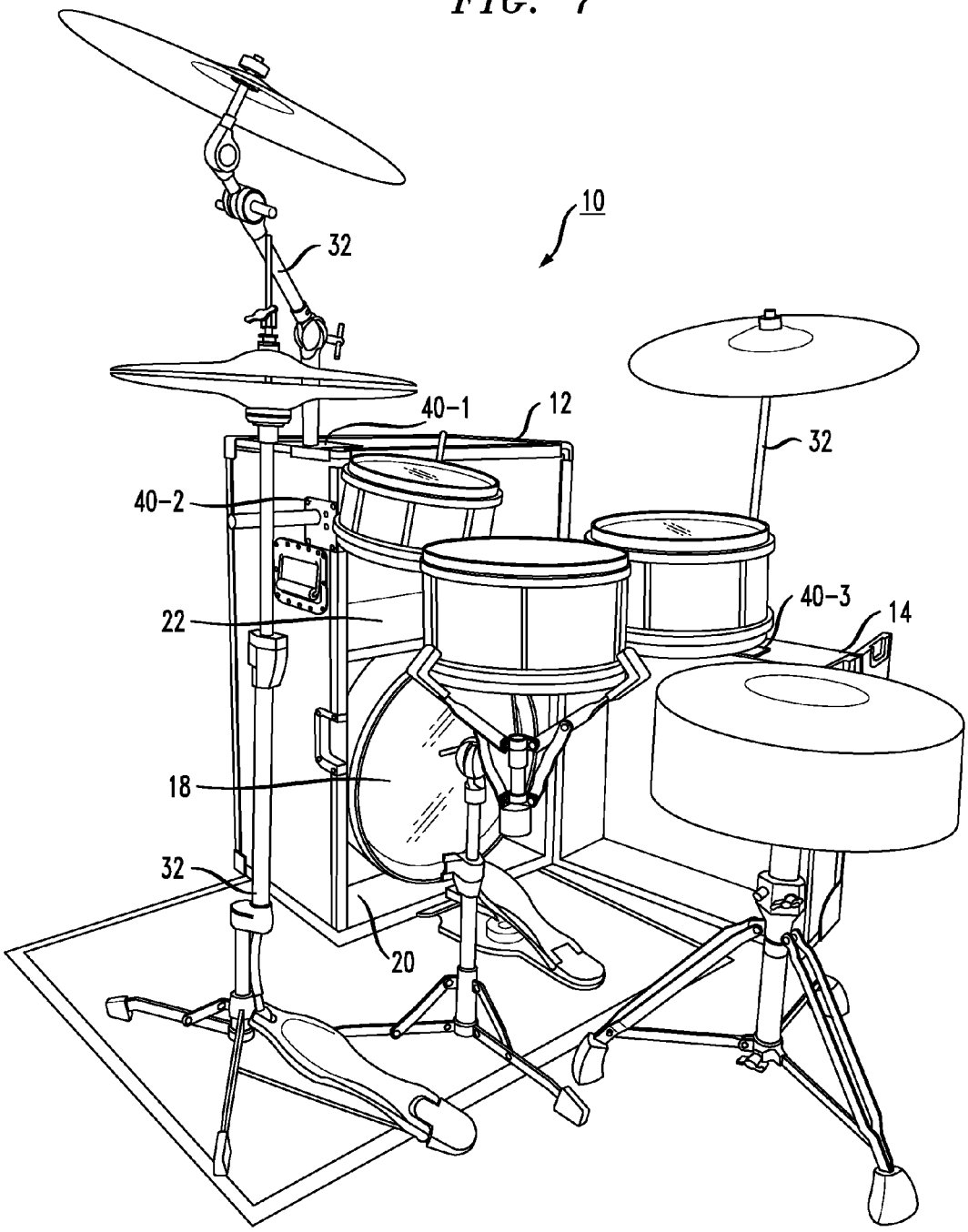
Figure 8:
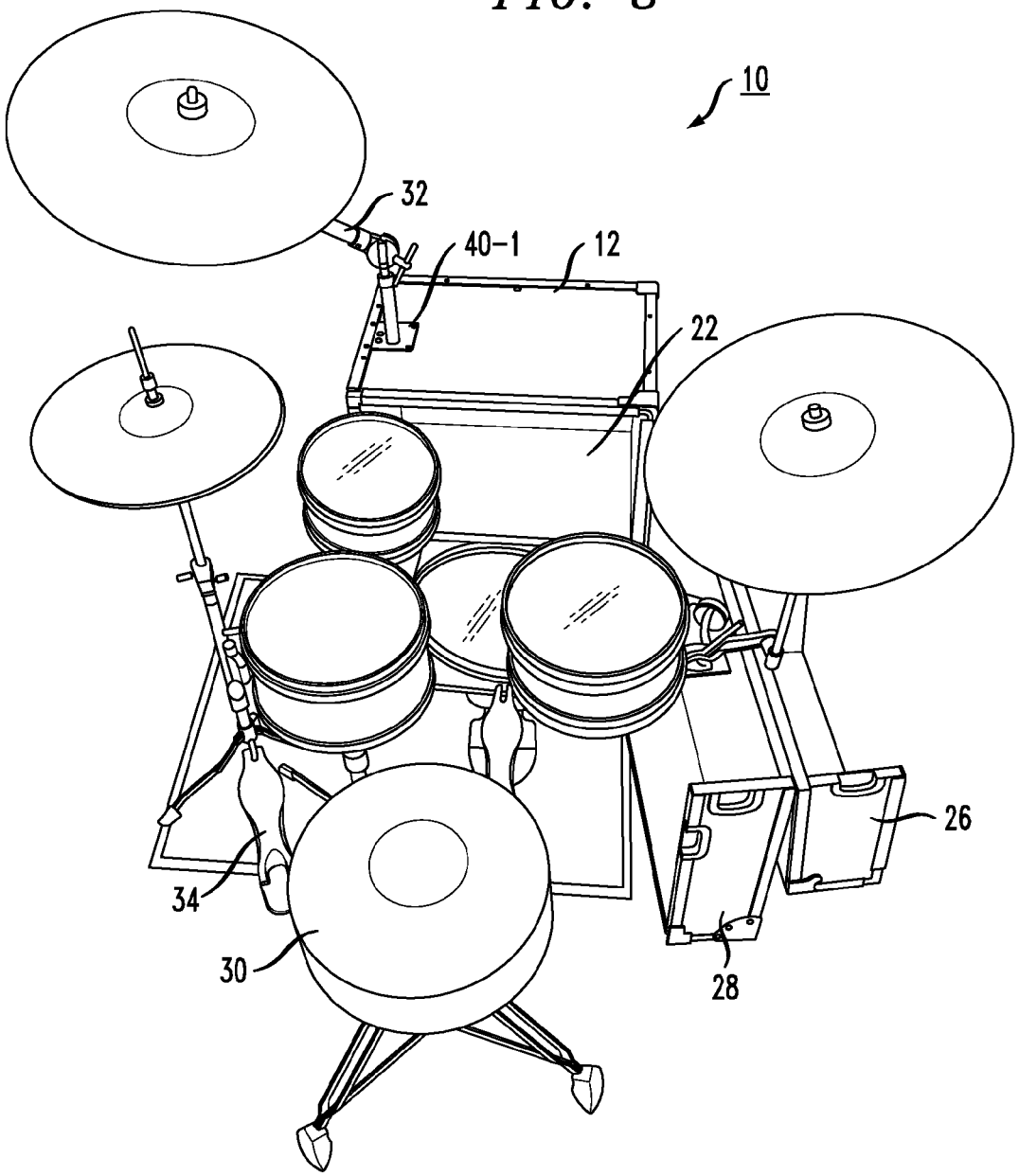

FIG. 4 illustrates drum kit container 10 at a further point in the drum kit set-up process. As shown, the remaining drums 24 have been removed from upper section 22 of main compartment area 12 and attached to the proper hardware 32.

In further accordance with the present invention, first and secondary compartment areas 12 and 14 of drum kit container 10 may be formed to include a plurality of attachment components 40 at specific locations, with these attachment components functioning as locations for attachment of some of the hardware 32 (and/or several cymbals that may be included in the fully set up drum kit. In this specific example of this aspect of the present invention, FIG. 2 illustrates a pair of attachment components 40-1 and 40-2 formed on its exterior surface and FIG. 3 illustrates an attachment component 40-3 formed in the upper wall 28-U of lower section 28 (and thus visible when secondary compartment area is opened). With reference to FIGS. 2, 3 and 4, it is shown that attachment components 40-1, 40-2 and 40-3 are used to provide attachment of a portion of hardware 32 to drum kit container 10. These hardware connections may be used to support, for example, cymbals that are used in the fully assembled drum kit.

FIGS. 5-8 illustrate an exemplary drum kit as set up for performance, utilizing drum kit container 10 of the present invention. Evident in each of these views is that bass drum 18 remains in position within container 10, which is formed in the specific manner shown below to provide the necessary acoustics for this relatively small-sized bass drum.

As mentioned above, container 10 is specifically formed in accordance with the present invention to include an acoustic configuration that allows for the relatively small bass drum 18 contained within lower section 20 of main compartment area 12 to create the richer, deeper sound generally attributed to larger (standard size) bass drums.

Figure 9:
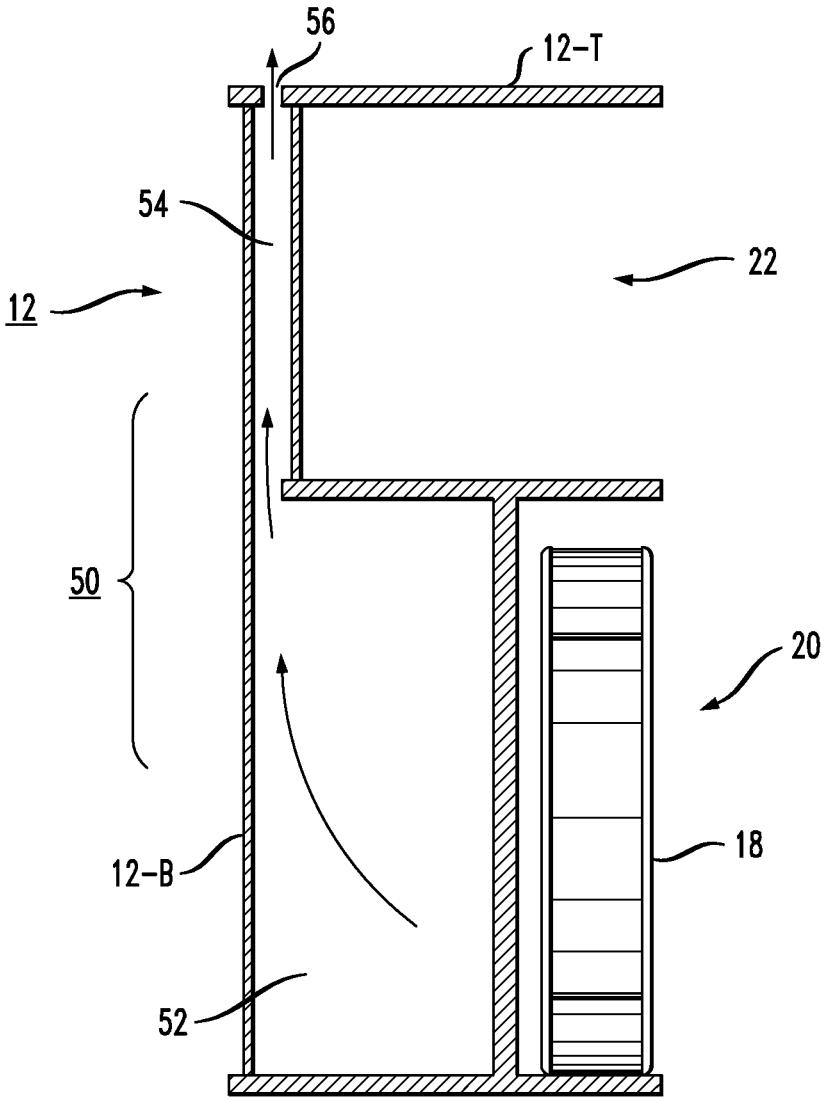
FIG. 9 is a cut-away side view of the main compartment area of the inventive drum kit container, the view of FIG. 9 illustrating an exemplary acoustic configuration disposed behind the bass drum and used for optimizing the sound of the bass drum.
Figure 10:
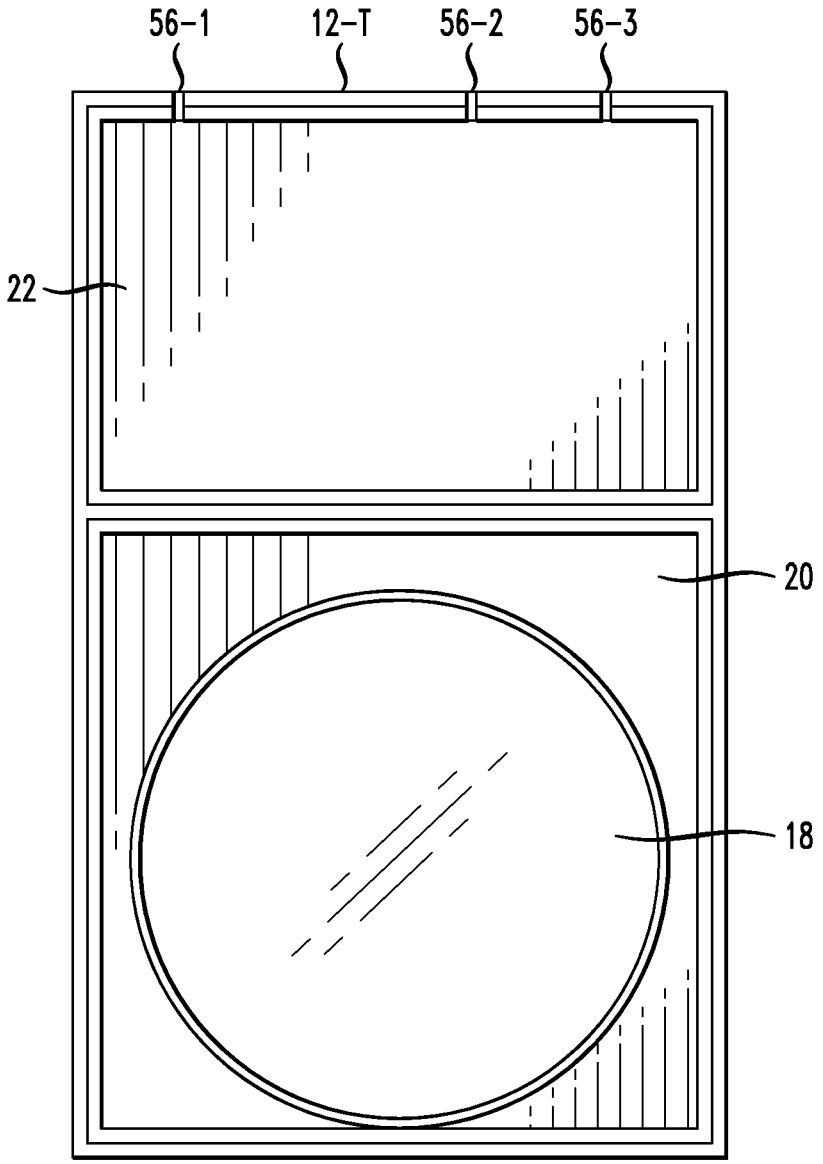
FIG. 10 is a front view of the main compartment shown in FIG. 9.

FIG. 9 is a cut-away side view of main compartment area 12, showing the elements forming an acoustic configuration 50 which in this embodiment includes an acoustic chamber 52 disposed in a second area of lower section 20, behind bass drum 18. A channel 54 is formed to be in acoustic communication with chamber 52 and is disposed to extend upwards within a back wall 12-B of main compartment area 12. As shown in FIG. 9, channel 54 terminates at an aperture 56 (such as a slot) formed in a top surface 12-T of main compartment area 12. FIG. 10 is a front view of the arrangement of FIG. 9, illustrating the position of drum 18 within lower section 20. Also shown in this view is a pair of apertures 56-1 and 56-2.

In accordance with the present invention, therefore, when "small" bass drum 18 positioned within lower section 20 is struck (such as with a conventional floor pedal), acoustic configuration 50 will allow the sound to reverberate within chamber 52, travel along channel 54 and outward through aperture 56. The inclusion of this acoustic configuration 50 improves the sound of "small" bass drum 18 and is critical in allowing for all of the drum kit components to be easily stored in a container of a relatively small size.

Figure 11:
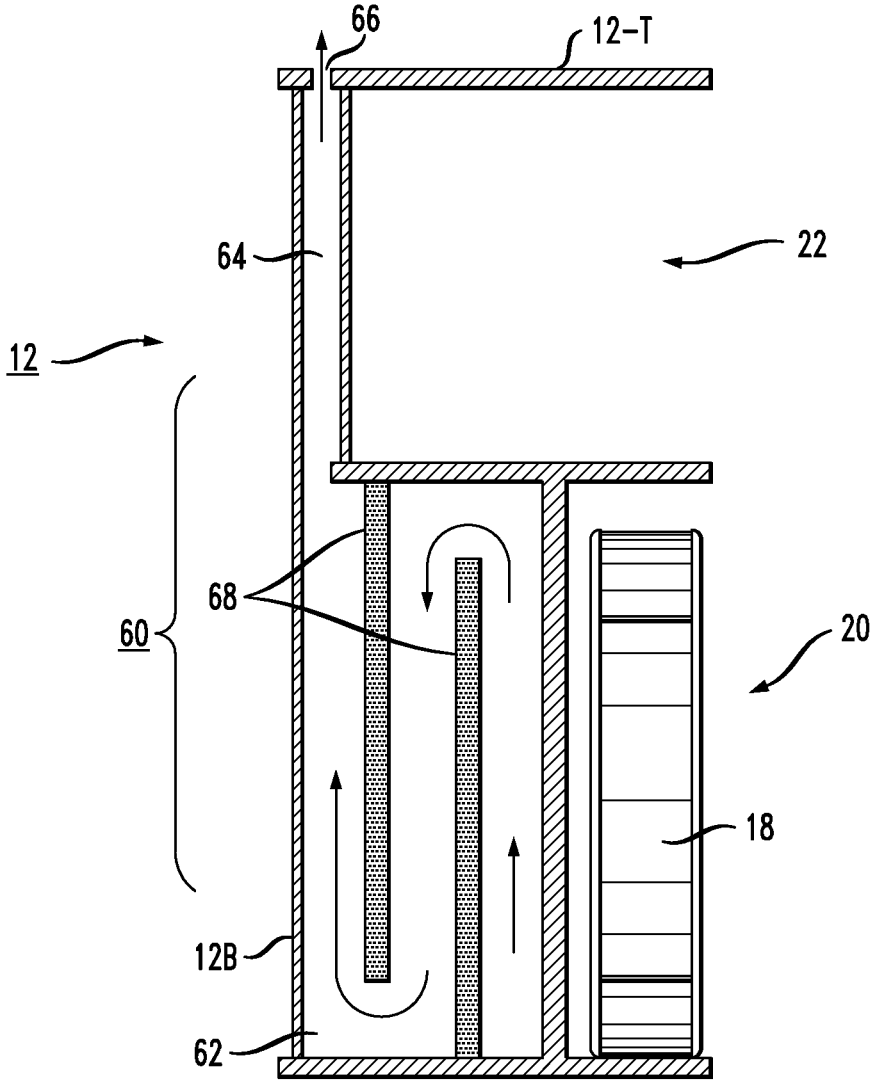
FIG. 11 is a cut-away view of an alternative acoustic configuration as formed within the main compartment, in this case including a number of baffles within the acoustic chamber.

FIG. 11 is a side view of an alternative acoustic configuration useful in drum kit container 10 in accordance with the present invention. As with the embodiment described above, main compartment area 12 includes a lower section 20 for holding bass drum 18. In the arrangement as shown in FIG. 11, an acoustic configuration 60 is shown as including an acoustic chamber 62, channel 64 and aperture(s) 66. Additionally, acoustic chamber 62 is formed to include a set of baffles 68, which are used to channel the acoustic wave through acoustic chamber 62 in a manner that creates a rich, deep bass drum sound. As with the configuration described above, the sound wave ultimately propagates upward through channel 64, passing through aperture slots 66 formed in top surface 12-T of first containment area 12.

It is to be understood that the specific configuration of baffles 68 is exemplary only and various other arrangements may be used. Indeed, it is to be further understood that a drum kit container formed in accordance with the present invention may include various other configurations and organizations of compartments, sections and attachment components, as long as the section within which the bass drum is located also includes an acoustic chamber. Thus, the spirit and scope of the present invention is not limited by this description, but only by the claims appended hereto.

What is claimed is:

1. A drum kit container of generally rectangular form, the container including an acoustic configuration and comprising a main compartment including an upper section and a lower section, the lower section including a first area and a second area configured in a front and back configuration such that the first and second areas are both disposed below the upper section, the first area for housing a small bass drum of a diameter no greater than 16 inches, the small bass drum affixed to the container so as to be retained within during use and disposed with a drumhead facing outward, and the second area including at least a portion of the acoustic configuration and comprising an acoustic chamber, the main compartment further comprising an acoustic channel in acoustic communication with the acoustic chamber and extending upward along a side surface of the main compartment, terminating in an aperture, the combination of the acoustic chamber, acoustic channel and aperture forming the acoustic configuration.

2. The drum kit container as defined in claim 1 wherein the upper section of the main compartment is sized to function as storage area for at least one other drum.

3. The drum kit container as defined in claim 2 wherein the upper section of the main compartment is sized to function as a storage area for a plurality of different drums.

4. The drum kit container as defined in claim 1 wherein the main compartment further comprises at least one attachment component disposed on the exterior surface thereof, the at least one attachment component utilized for providing attachment of drum hardware used in a drum kit set up.

5. The drum kit container as defined in claim 1 wherein the container further comprises a secondary compartment having the same surface area dimensions as the main compartment such that the secondary compartment is disposed over and attached to the main compartment, the combination of the main and secondary compartments forming a container for housing the small bass drum and other drum equipment in a portable, compact arrangement.

6. The drum kit container as defined in claim 5 wherein the secondary compartment includes at least a pair of separate sections used for storage of drum equipment.

7. The drum kit container as defined in claim 5 wherein the main compartment is coupled to the secondary compartment with a hinge element.

8. The drum kit container as defined in claim 5 wherein the secondary compartment further comprises at least one attachment component for providing a location for the attachment of drum hardware to the secondary compartment.

9. The drum kit container as defined in claim 6 wherein the secondary compartment further comprises a hinge connection formed between the a first section and a second section of the at least a pair of separate sections.

10. The drum kit container as defined in claim 9 wherein the secondary compartment includes at least one attachment component formed along a surface exposed when the hinge connection is opened.

* * * * *